US011571921B2

(12) United States Patent
Bie et al.

(10) Patent No.: US 11,571,921 B2
(45) Date of Patent: Feb. 7, 2023

(54) THERMOSENSITIVE RECORDING MEDIUM

(71) Applicants: Pauline Bie, Wettolsheim (FR); Daiki Iwata, Tokyo (JP); Erkan Kocak, Wettolsheim (FR)

(72) Inventors: Pauline Bie, Wettolsheim (FR); Daiki Iwata, Tokyo (JP); Erkan Kocak, Wettolsheim (FR)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/415,850

(22) PCT Filed: Dec. 19, 2019

(86) PCT No.: PCT/JP2019/049925
§ 371 (c)(1),
(2) Date: Jun. 18, 2021

(87) PCT Pub. No.: WO2020/130099
PCT Pub. Date: Jun. 25, 2020

(65) Prior Publication Data

US 2022/0080761 A1 Mar. 17, 2022

(30) Foreign Application Priority Data

Dec. 19, 2018 (EP) ..... 18306747

(51) Int. Cl.
*B41M 5/42* (2006.01)

(52) U.S. Cl.
CPC ..... *B41M 5/423* (2013.01); *B41M 2205/40* (2013.01)

(58) Field of Classification Search
CPC .... B29B 7/90; B29B 9/06; B29B 9/14; B29B 45/14336; B29B 70/08; B29B 70/16;
(Continued)

(56) References Cited

U.S. PATENT DOCUMENTS 5,851,951 A * 12/1998 Yamori ..... B41M 5/42 503/216
6,162,836 A 12/2000 Kato
(Continued)

FOREIGN PATENT DOCUMENTS

CN 1388779 1/2003
CN 105283316 1/2016
(Continued)

OTHER PUBLICATIONS

International Search Report dated Apr. 2, 2020 in PCT/JP2019/049925.
Chinese 1st Office Action for 201980083657.X dated Mar. 25, 2022.
Japanese Office Action for 2021-533630 dated May 31, 2022.
Office Action dated Aug. 10, 2022 issued with respect to the corresponding Korean Patent Application No. 10-2021-7018605.

*Primary Examiner* — Christopher M Polley
*Assistant Examiner* — Sathavaram I Reddy
(74) *Attorney, Agent, or Firm* — IPUSA, PLLC

(57) ABSTRACT

In one aspect, the present invention relates to a thermosensitive recording medium comprising at least: —a support layer; —a thermosensitive colouring layer over the support layer, the thermosensitive colouring layer containing a leuco dye; and —a protective layer over the thermosensitive colouring layer; wherein the thermosensitive colouring layer comprises a developer having the general formula (I) below: wherein $R_1$ to $R_3$ each independently represent a hydrogen atom, a halogen atom, a C1-C6 alkyl group, a C1-C6 alkoxyl group, a C1-C6 fluoroalkyl group; characterized in that the protective layer comprises particles of wax with an average particle size of at least 0.05 μm and at most 2.0 μm. In further aspects, the present invention relates to a label for attachment to a product comprising the thermosensitive recording medium of the invention, and to a consumer product pack-
(Continued)

age to which a thermosensitive recording medium or a label of the invention has been attached.

(I)

21 Claims, 2 Drawing Sheets

(58) Field of Classification Search
CPC ..... B29K 2063/00; B29K 2101/10; B29K 2713/00; B29K 2995/0003; B29K 2995/0005; B29L 2031/34; B32B 5/022; B32B 5/28; B32B 27/12; B32B 27/20; B32B 2457/00; H05K 5/0217; H05K 9/009; B41M 5/423; B41M 2205/40
See application file for complete search history.

(56) References Cited

U.S. PATENT DOCUMENTS

| | | | | |
|---|---|---|---|---|
| 9,962,980 | B2 | 5/2018 | Morie et al. | |
| 2002/0187897 | A1 | 12/2002 | Ishida et al. | |
| 2003/0165602 | A1* | 9/2003 | Garwood | A23B 4/16 426/392 |
| 2004/0126530 | A1 | 7/2004 | Finger | |
| 2011/0033642 | A1 | 2/2011 | Ikeda et al. | |
| 2015/0367663 | A1* | 12/2015 | Yamane | B41M 5/3331 503/216 |
| 2016/0082760 | A1 | 3/2016 | Takano et al. | |
| 2016/0236496 | A1* | 8/2016 | Morie | B41M 5/3375 |
| 2018/0001730 | A1 | 1/2018 | Stork et al. | |

FOREIGN PATENT DOCUMENTS

| | | |
|---|---|---|
| EP | 2923851 | 9/2015 |
| EP | 2957427 | 12/2015 |
| EP | 3053753 | 8/2016 |
| JP | H08-324123 | 12/1996 |
| JP | H09-277701 | 10/1997 |
| JP | 2006-248178 | 9/2006 |
| JP | 2011-051334 | 3/2011 |
| JP | 2015-150764 | 8/2015 |
| JP | 2018-043363 | 3/2018 |
| KR | 10-2005-0072752 | 7/2005 |

* cited by examiner

[Fig. 1]
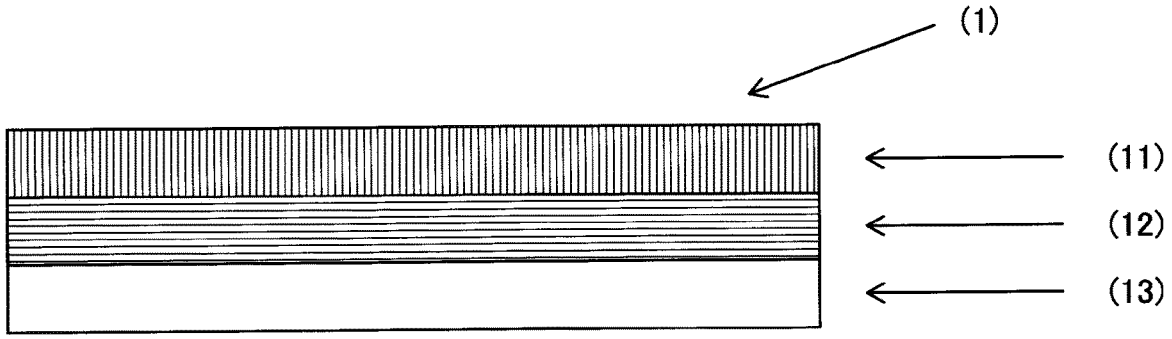
[Fig. 2]
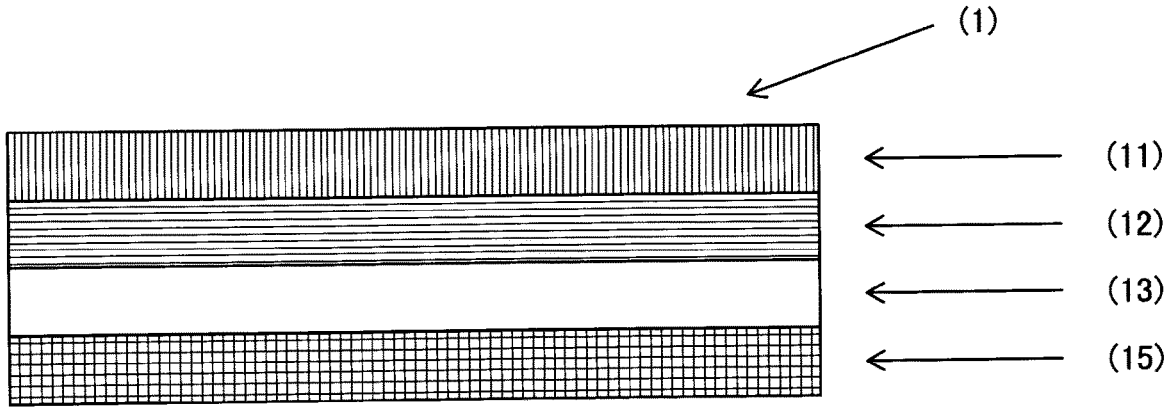

[Fig. 3]
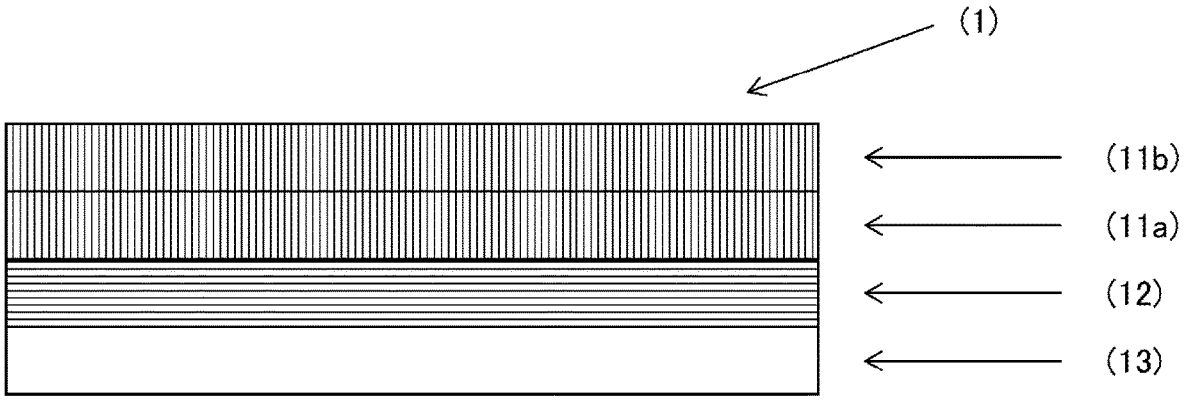
[Fig. 4]
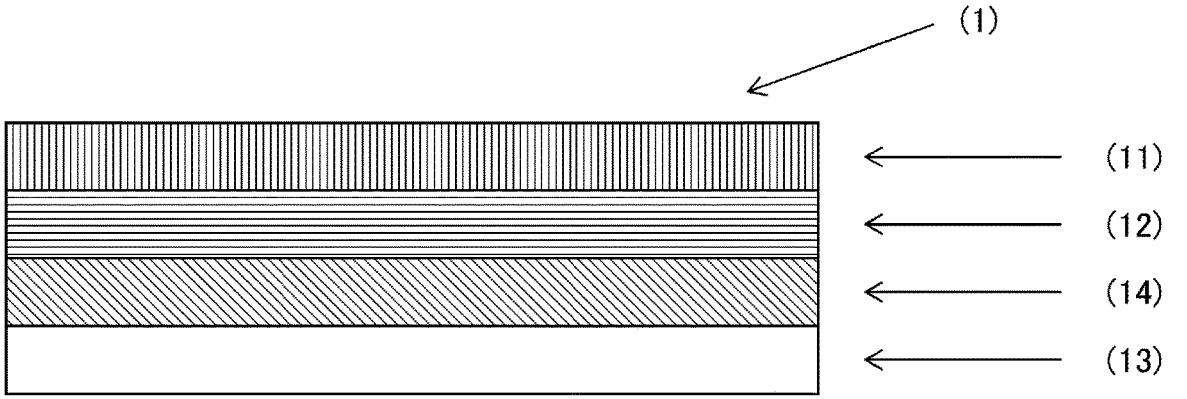

THERMOSENSITIVE RECORDING MEDIUM

The present application is based on and claims priority of European Patent Application No. 18306747.9 filed on Dec. 19, 2018, the entire contents of which are hereby incorporated herein by reference.

TECHNICAL FIELD

The present invention relates in one of its aspects to a thermosensitive recording medium. In further aspects, the present invention relates to a label for attachment to a product comprising the thermosensitive recording medium of the invention, and to a consumer product package to which a thermosensitive recording medium or a label of the invention has been attached.

BACKGROUND ART

Thermosensitive recording mediums are known which use a colorant system wherein a dye, such as a leuco dye, in one layer of the medium reacts, upon the application of heat, with another component, a so-called "developer", in order to give rise to a coloured product. Concerning the leuco dye—developer couple, phenols can successfully be used as developers in thermal paper. However, notably for environmental reasons, it is preferred to try to avoid using phenols in this context. N-phenylureido-phenyl-benzenesulfonamides have been proposed, for example in EP 2 923 851 and JP-2015-150764, as non-phenol developers in this context. Of particular interest is the developer compound having the following structure:

[Chem.1]

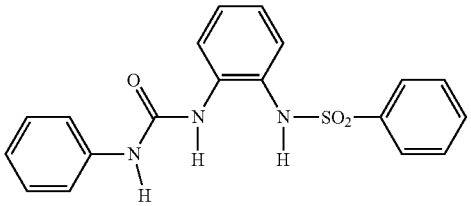

CITATION LIST

Patent Literature

[PTL 1] EP 2 923 851
[PTL 2] JP-2015-150764

SUMMARY OF INVENTION

Technical Problem

However, it has been observed that when using an N-phenylureido-phenyl-benzenesulfonamide, such as the compound shown above, in the thermosensitive colouring layer of a thermosensitive recording medium, a problem of undesirable pigment transfer may occur. For example, where thermosensitive recording mediums are attached to products that are stacked and displayed, in the stacked state, a plastic film covering a package may be in contact with a thermosensitive recording material, e.g. a product description label, attached to another package (below in the stack), and a "black transfer" may take place wherein a black colour is transferred to the plastic film covering the (upper) package, from the thermosensitive colouring layer of the thermosensitive recording material, e.g. a product description label, attached to the other (lower) package. Without wishing to be bound by any particular theory, it is believed that plasticizers typically used in plastic films may promote migration of N-phenylureido-phenyl-benzene sulfonamide materials.

Solution to Problem

With a view to solving problems among those indicated above, the present invention, in one aspect, relates to a thermosensitive recording medium comprising at least:

- a support layer;
- a thermosensitive colouring layer over the support layer, the thermosensitive colouring layer containing a leuco dye; and
- a protective layer over the thermosensitive colouring layer;

wherein the thermosensitive colouring layer comprises a developer having the general formula (I) below:

[Chem.2]

(I)

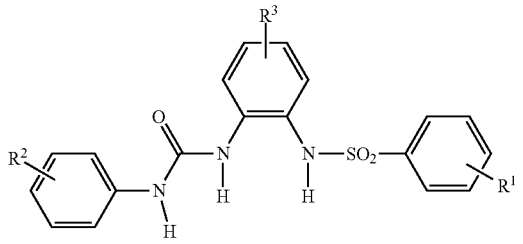

wherein $R_1$ to $R_3$ each independently represent a hydrogen atom, a halogen atom, a C1-C6 alkyl group, a C1-C6 alkoxyl group, a C1-C6 fluoroalkyl group; characterized in that the protective layer comprises particles of wax with an average particle size of at least 0.05 μm and at most 2.0 μm.

In another aspect, the present invention relates to a thermosensitive recording medium of the invention configured as a label for attachment to product requiring labelling such as a consumer product. The thermosensitive recording medium of the invention configured as a label may have a releasable liner (release paper), or may be a linerless-type label, such as a silicone linerless (SLL) label. In another aspect, the present invention relates to a consumer product package to which a thermosensitive recording medium of the invention has been attached. The consumer product package may be partially or fully transparent, flexible or rigid, and may contain one or more perishable food items, such as delicatessen products or box lunches. The consumer product package may be covered with a plastic film including a plasticizer, wherein the plastic film may be a poly(vinyl chloride) film.

BRIEF DESCRIPTION OF DRAWINGS

FIG. 1 is a schematic representation of an illustrative, non-limiting example of a thermosensitive recording medium according to one embodiment of the present invention. In this particular and non-limiting embodiment, in the thermosensitive recording medium (1), the thermosensitive colouring layer (12), placed over the support layer (13), is in contact with the support layer (13), and the thermosensitive colouring layer (12) is also in contact with a protective layer (11).

FIG. 2 is a schematic representation of another illustrative, non-limiting example of a thermosensitive recording medium according to a further embodiment of the present invention. Here, the arrangement is analogous to the embodiment shown in FIG. 1, except that a back layer (15), placed under the support layer (13), is in contact with the support layer (13).

FIG. 3 is a schematic representation of another illustrative, non-limiting example of a thermosensitive recording medium according to a further embodiment of the present invention. Here, the arrangement is analogous to the embodiment shown in FIG. 1, except that two successive protective layers, here numbered (11*a*) and (11*b*), (11*a*) being the lower protective layer and (11*b*) being the upper protective layer, are applied to the thermosensitive colouring layer (12). In such an arrangement, the upper protective layer (11*b*) will appropriately contain wax particles, but wax particles are then not necessary in the lower protective layer (11*a*).

FIG. 4 is a schematic representation of another illustrative, non-limiting example of a thermosensitive recording medium according to a further embodiment of the present invention. Here, the arrangement is analogous to the embodiment shown in FIG. 1, except that an undercoat layer (14) is incorporated between the support layer (13) and the thermosensitive colouring layer (12).

DESCRIPTION OF EMBODIMENTS

Support Layer

The support layer in the thermosensitive recording medium of the present invention is suitably selected depending on the intended purpose without any particular restriction. It is possible for this support layer to be transparent or non-transparent.

Possible supports may include supports made of wood-free paper, recycled pulp (containing 50% or more of recycled pulp), synthetic paper, polyethylene films, and laminated paper. The thickness of a paper layer varies depending on the composition of the layer and intended use of the thermosensitive recording materials and cannot be specified flatly, but it is preferably 30 μm to 250 μm, more preferably 50 μm to 200 μm.

A transparent support may also be used in the form of a polymeric material present in the form of a thin film. The total light transmittance of the transparent film is preferably at least 60%, more preferably at least 70% and most preferably at least 90%. Preferred films show a haze value less than 3. The transparent film may also be coloured. The thickness of the transparent film is preferably from 20 μm to 100 μm, more preferably 40 μm to 70 μm.

Film materials to be used in the transparent support may be selected from the group consisting of: ionomer film (IO), polyethylene film (PE), poly(vinyl chloride) film (PVC), poly(vinylidene chloride) film (PVDC), poly(vinyl alcohol) film (PVA), polypropylene film (PP) including biaxially oriented (bi-oriented) polypropylene (BOPP), polyester film, poly(ethylene terephthalate) film (PET), polyethylene naphthalate) film (PEN), polycarbonate film (PC), polystyrene film (PS), polyacrylonitrile film (PAN), ethylene-vinyl acetate copolymer film (EVA), ethylene-vinyl alcohol copolymer film (EMAA), nylon film (NY), polyamide film (PA), triacetyl cellulose film (TAC), norbornane film (NB), and Arton film. Other possibilities include polyethylene (PE) and polymethyl methacrylate (PMMA).

Undercoat Layer(s)

In the technical field of thermosensitive recording mediums in general, the expression "undercoat" is understood by the skilled person to refer to the layer between the support and thermosensitive colouring layer. The expression "under layer" may also be used synonymously with "undercoat layer" by skilled persons in the field.

In the present invention, an undercoat layer may be provided or not i.e. the undercoat layer is merely an option in the present invention, and the thermosensitive recording medium of the present invention may or may not contain such an undercoat layer.

If present in the thermosensitive recording medium of the present invention, the undercoat layer will contain a binder resin, and the undercoat layer may further contain other components such as a filler, and other additives.

As for the binder resin to be used in an undercoat layer, either of a water-dispersible resin or a water-soluble resin may be used. Specific examples thereof include conventionally known water-soluble polymers, and aqueous polymer emulsions.

The water-soluble polymer that may be used in the binder resin in an undercoat layer may be suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyvinyl pyrrolidone, alkali salts of styrene-maleic anhydride copolymers, alkali salts of isobutylene-maleic anhydride copolymers, alginate soda, gelatin and casein. These may be used alone or in combination. A particularly preferred binder material for an undercoat layer of the present invention is polyvinyl alcohol.

The aqueous polymer emulsion that may be used in the binder resin in an undercoat layer may be suitably selected depending on the intended purpose without any restriction. Examples thereof include latexes of, for example, styrene-butadiene copolymers; and emulsions of, for example, vinyl acetate resins, acryl-based resins and polyurethane resins. These may be used alone or in combination.

An inorganic filler may be used or may be omitted from an undercoat layer if an undercoat layer is used in the thermosensitive recording medium of the present invention. If an inorganic filler is used, examples thereof include aluminum hydroxide, calcium carbonate, aluminum oxide, zinc oxide, titanium dioxide, silica, barium sulfate, talc, kaolin, alumina and clay. These may be used alone or in combination. Among these, aluminum hydroxide, calcium carbonate, kaolin and clay are preferable in terms of liquid properties in a coating liquid, stability of dispersed particles, and water solubility.

As components contained in undercoat layers of a thermosensitive recording medium, it is known, in order to improve printing quality, to use hollow particles having a hollow ratio of 50% or more or indeed 80% or more, or 90% or more, wherein the hollow ratio (in %) is the (inner diameter of a hollow particle/outer diameter of the hollow particle)×100. Each of such hollow particles may have a shell made of a thermoplastic resin and contain therein air or other gas, typically with a volume average particle diameter of 1 μm to 10 μm, most commonly having a thermoplastic resin as a shell, made from polystyrene, polyvinyl chloride, polyvinylidene chloride, polyvinyl acetate, polyacrylic ester, polyacrylonitrile, and polybutadiene, and copolymer resins thereof.

If an undercoat layer is used in the thermosensitive recording medium of the present invention, the deposition amount thereof is appropriately 0.4 g/m$^2$ to 10 g/m$^2$, more preferably 0.6 g/m$^2$ to 4 g/m$^2$.

The thickness of an undercoat layer in the present invention, if used, varies depending on the composition of the layer and intended use of the thermosensitive recording materials and cannot be specified flatly, but it is preferably 0.5 μm to 15 μm, more preferably 0.8 μm to 6 μm.

Thermosensitive Colouring Layer

In the thermosensitive recording medium of the present invention, the thermosensitive colouring layer is situated over the transparent support layer, and the thermosensitive colouring layer contains a leuco dye and a developer. The thermosensitive colouring layer may be in direct contact with one face of the transparent support layer or alternatively, as discussed above, an undercoat layer (or undercoat layers) may be present between the transparent support layer and the thermosensitive colouring layer.

The thermosensitive colouring layer contains a colorant system wherein a dye, such as a leuco dye, in one layer of the medium reacts, upon the application of heat, with another component, a so-called "developer", in order to give rise to a coloured product.

The leuco dye is a compound exhibiting electron donation properties, and may be used singly or in combination of two or more species. However, the leuco dye itself is a colourless or light-coloured dye precursor, and commonly known leuco compounds can be used. Examples of the leuco compounds include triphenylmethane phthalide compounds, triarylmethane compounds, fluoran compounds, phenothiazine compounds, thiofluoran compounds, xanthen compounds, indophthalyl compounds, spiropyran compounds, azaphthalide compounds, chlormenopirazole compounds, methyne compounds, rhodamine anilinolactum compounds, rhodamine lactuam compounds, quinazoline compounds, diazaxanthen compounds, bislactone compounds. In consideration of colouring property, fogging of the background, and colour fading of the image due to moisture, heat or light radiation, specific examples of such compounds are as follows:

2-anilino-3-methyl-6-diethyl amino fluoran, 2-anilino-3-methyl-6-(di-n-butyl amino) fluoran, 2-anilino-3-methyl-6-(di-n-pentyl amino) fluoran, 2-anilino-3-methyl-6-(N-n-propyl-N-methyl amino) fluoran, 2-anilino-3-methyl-6-(N-isopropyl-N-methyl amino) fluoran, 2-anilino-3-methyl-6-(N-isobutyl-N-methyl amino) fluoran, 2-anilino-3-methyl-6-(N-n-amyl-N-methyl amino) fluoran, 2-anilino-3-methyl-6-(N-sec-butyl-N-ethyl amino) fluoran, 2-anilino-3-methyl-6-(N-n-amyl-N-ethyl amino) fluoran, 2-anilino-3-methyl-6-(N-iso-amyl-N-ethyl amino) fluoran, 2-anilino-3-methyl-6-(N-cyclohexyl-N-methyl amino) fluoran, 2-anilino-3-methyl-6-(N-ethyl-p-toluidino) fluoran, 2-anilino-3-methyl-6-(N-methyl-p-toluidino) fluoran, 2-(m-trichloro methyl anilino)-3-methyl-6-diethyl amino fluoran, 2-(m-trifluoro methyl anilino)-3-methyl-6-diethyl amino fluoran, 2-(m-trifluoro methyl anilino)-3-methyl-6-(N-cyclohexyl-N-methyl amino) fluoran, 2-(2,4-dimethyl anilino)-3-methyl-6-diethyl amino fluoran, 2-(N-ethyl-p-toluidino)-3-methyl-6-(N-ethyl anilino) fluoran, 2-(N-methyl-p-toluidino)-3-methyl-6-(N-propyl-p-toluidino) fluoran, 2-anilino-6-(N-n-hexyl-N-ethyl amino) fluoran, 2-(o-chloranilino)-6-diethyl amino fluoran, 2-(o-bromoanilino)-6-diethyl amino fluoran, 2-(o-chloranilino)-6-dibutyl amino fluoran, 2-(o-fluoroanilino)-6-dibutyl amino fluoran, 2-(m-trifluoro methyl anilino)-6-diethylamino fluoran, 2-(p-acetyl anilino)-6-(N-n-amyl-N-n-butyl amino) fluoran, 2-benzyl amino-6-(N-ethyl-p-toluidino) fluoran, 2-benzyl amino-6-(N-methyl-2,4-dimethyl anilino) fluoran, 2-benzyl amino-6-(N-ethyl-2,4-dimethyl anilino) fluoran, 2-dibenzyl amino-6-(N-methyl-p-toluidino) fluoran, 2-dibenzyl amino-6-(N-ethyl-p-toluidino) fluoran, 2-(di-p-methyl benzyl amino)-6-(N-ethyl-p-toluidino) fluoran, 2-(a-phenyl ethyl amino)-6-(N-ethyl-p-toluidino) fluoran, 2-methyl amino-6-(N-methyl anilino) fluoran, 2-methyl amino-6-(N-ethyl anilino) fluoran, 2-methyl amino-6-(N-propyl anilino) fluoran, 2-ethyl amino-6-(N-methyl-p-toluidino) fluoran, 2-methyl amino-6-(N-methyl-2,4-dimethyl anilino) fluoran, 2-ethyl amino-6-(N-methyl-2,4-dimethyl anilino) fluoran, 2-dimethyl amino-6-(N-methyl anilino) fluoran, 2-dimethyl amino-6-(N-ethyl anilino) fluoran, 2-diethyl amino-6-(N-methyl-p-toluidino) fluoran, benzo leuco methylene blue, 2-[3,6-bis(diethyl amino)]-6-(o-chloranilino) xanthyl benzoic acid lactum, 2-[3,6-bis(diethyl amino)]-9-(o-chloranilino) xanthyl benzoic acid lactum, 3,3-bis(p-dimethyl amino phenyl) phthalide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorphthalide, 3,3-bis(p-dibutyl amino phenyl) phthalide, 3-(2-methoxy-4-dimethyl amino phenyl)-3-(2-hydroxy-4,5-dichlorophenyl) phthalide, 3-(2-hydroxy-4-dimethyl amino phenyl)-3-(2-methoxy-5-chlorophenyl) phthalide, 3-(2-hydroxy-4-dimethoxy amino phenyl)-3-(2-methoxy-5-chlorophenyl) phthalide, 3-(2-hydroxy-4-dimethoxy amino phenyl)-3-(2-methoxy-5-nitrophenyl) phthalide, 3-(2-hydroxy-4-diethyl amino phenyl)-3-(2-methoxy-5-methyl phenyl) phthalide, 3,6-bis(dimethyl amino) fluorenespiro (9,3')-6'-dimethyl amino phthalide, 6'-chloro-8'-methoxy-benzoindolino spiropyran, and 6'-bromo-2'-methoxy benzoindolino spiropyran. These may be used alone or in combination.

The amount of the leuco dye contained in the thermosensitive colouring layer is P 3% by mass to 30% by mass, with respect to the total mass of the thermosensitive colouring layer take as 100%.

As the developer, various electron accepting materials are known to be able to react with the aforementioned leuco dye at the time of heating so as to develop colours, such as phenolic compounds, organic or inorganic acidic compounds and esters or salts thereof.

In the present invention, the thermosensitive colouring layer comprises a developer having a N-phenylureido-phenyl-benzenesulfonamide structure and more particularly having the general formula (I) below:

[Chem.3]

(I)

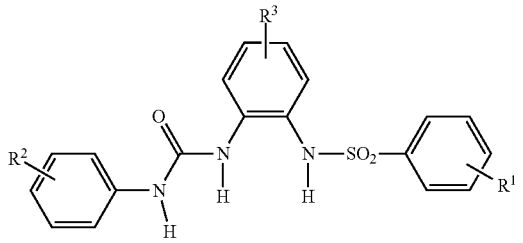

wherein $R_1$ to $R_3$ each independently represent a hydrogen atom, a halogen atom, a C1-C6 alkyl group, a C1-C6 alkoxyl group, or a C1-C6 fluoroalkyl group.

Such developers can be prepared according to methods of synthesis disclosed for example in EP 2 923 851.

In a particularly preferred embodiment, the thermosensitive colouring layer of the thermosensitive recording medium of the invention comprises a developer having the following formula (II):

[Chem.4]

(II)

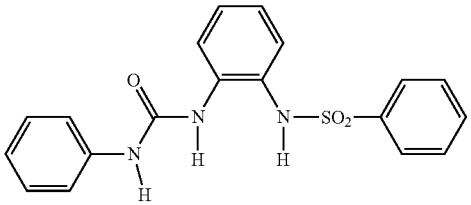

This corresponds to the general formula (I) above in which $R^1$, $R^2$ and $R^3$ are all hydrogen atoms.

In preferred embodiments of the present invention, the thermosensitive colouring layer of the thermosensitive recording medium also contains at least one further developer, and notably one of the following (all commercial products):

the compound of formula (II), is at least 0.02 to at most 2.0. More preferably, the weight ratio of urea urethane (UU) in the thermosensitive colouring layer, with respect to the amount of developer having the general formula (I) such as the compound of formula (II), is at least 0.05 to at most 0.20. Most preferably, the amount by weight of UU in the thermosensitive colouring layer, with respect to the developer having the general formula (I) such as the compound of formula (II), is at least 0.05 and at most 0.10. It has been found by the present inventors experimentally that the use of urea urethane (UU) significantly contributes to reducing migration of coloured components which are or which arise from developers having the general formula (I), and therefore improve the effect of the present invention. However, the present inventors also found that too high a level of urea urethane (UU) reduces alcohol resistance of the thermosensitive recording medium.

In the thermosensitive colouring layer, the mixing ratio of the developer(s) to the leuco dye(s) is such that the developer(s) is (are) preferably 0.5 parts by mass to 10 parts by mass, more preferably 1 part by mass to 5 parts by mass, relative to 1 part by mass of the leuco dye(s). The combined mass of developer(s) of formula (I) together with the above-

[Chem.5]

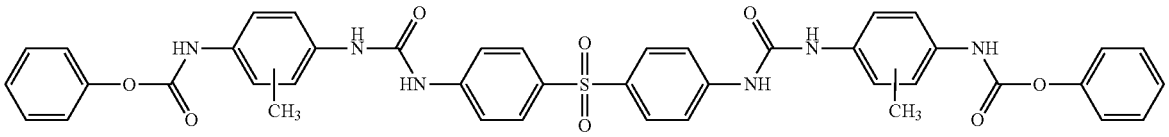

Urea Urethane Compound

[Chem.6]

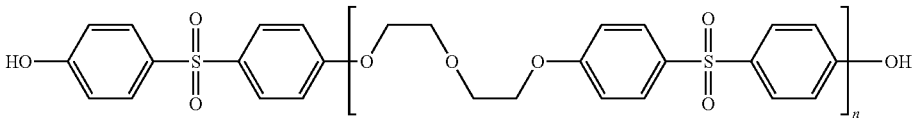

D90

[Chem.7]

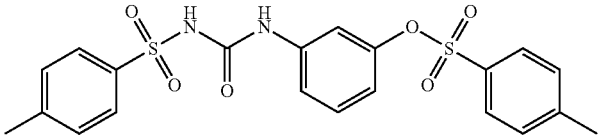

Pergafast 201

In a preferred embodiment, the co-developer is a urea urethane (UU) compound of formula:

referenced UU, D90 and Pergafast 201 products, is thus preferably 0.5 parts by mass to 10 parts by mass, more

[Chem.8]

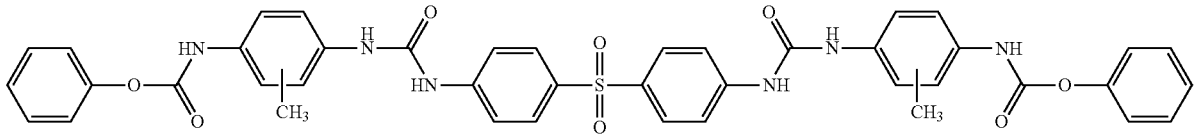

Advantageously, the weight ratio of urea urethane (UU) in the thermosensitive colouring layer, with respect to the amount of developer having the general formula (I), such as preferably 1 part by mass to 5 parts by mass, relative to 1 part by mass of the leuco dye(s) in the thermosensitive colouring layer.

In the present invention, various other known developers can optionally be used as long as the effects of the present invention are not impaired. These other developers are color developers including various electron-accepting compounds and oxidants capable of coloring the leuco dye. Examples thereof include 4,4'-isopropylidene bisphenol, 4,4'-isopropylidene bis(o-methylphenol), 4,4'-secondary butylidene bisphenol, 4,4'-isopropylidene bis(2-tert-butylphenol), zinc p-nitrobenzoate, 1,3,5-tris(4-tert-butyl-3-hydroxy-2,6-dimethylbenzyl)isocyanurate, 2,2-(3,4'-dihydroxydiphenyl)propane, bis(4-hydroxy-3-methylphenyl) sulfide, 4'{6-(p-methoxyphenoxy)ethoxy}salicylate, 1,7-bis(4-hydroxyphenylthio)-3,5-dioxaheptane, 1,5-bis(4-hydroxyphenylthio)-5-oxapentane, monocalcium monobenzyl phthalate, 4,4'-cyclohexylidene diphenol, 4,4'-isopropylidene bis(2-chlorophenol), 4,4'-diphenolsulfone, 4-isopropoxy-4'-hydroxydiphenylsulfone, 4-benzyloxy-4'-hydroxydiphenylsulfone, 4,4'-diphenolsulfoxide, isopropyl-p-hydroxy benzoate, benzyl p-hydroxy benzoate, benzyl protocatechuic acid, stearyl gallate, lauryl gallate, octyl gallate, 1,3-bis(4-hydroxyphenylthio)-propane, N,N'-diphenyl thiourea, N,N'-di(m-chlorophenyl)thiourea, salicylanilide, methyl bis-(4'hydroxyphenyl) acetate, benzyl bis-(4-hydroxyphenyl) acetate, 1,3-bis(4-hydroxycumyl) benzene, 1,4-bis(4-hydroxycumyl)benzene, 2,4'-diphenolsulfone, 2,2'-diallyl-4,4'-diphenolsulfone, 3,4-dihydroxyphenyl-4'-methyldiphenylsulfone, zinc 1-acetyloxy-2-naphthoate, zinc 2-acetyloxy-1-naphthoate, zinc 2-acetyloxy-3-naphthoate, a,a-bis(4-hydroxyphenyl)-a-methyltoluene, an antipyrine complex of zinc thiocyanate. These may be used alone, or in combination.

An amount of the additional colour developer is appropriately selected depending on the intended purpose as long as the effects of the present invention are not impaired. In preferred embodiments, the combined mass of other developer(s), not being those of formula (I) or UU, D90 and Pergafast 201 products, is less than 2 parts by mass, relative to 1 part by mass of the leuco dye(s) in the thermosensitive colouring layer, more preferably less than 0.5 parts by mass relative to 1 part by mass of the leuco dye(s) in the thermosensitive colouring layer. In certain embodiments of the present invention, there may be substantially no other developer(s) present in the thermosensitive colouring layer other than those of formula (I) or UU, D90 and Pergafast 201 products.

Various known stabilizers (preservability-improving agents) can optionally be used as long as the effects of the present invention are not impaired. Most commonly, these stabilizers are hindered phenol compounds or hindered amine compounds. The latter type of electron-accepting compounds have relatively low colouring ability, and may be optionally added to the thermosensitive recording layer as an auxiliary additive. Specific examples thereof include: 2,2'-methylenebis(4-ethyl-6-tert-butylphenol), 4,4'-butylidene bis(6-tert-butyl-2-methylphenol), 1,1,3-tris (2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methylphenol), tetrabromobisphenol A, tetrabromobisphenol S, 4,4-thiobis(2-methylphenol), 4,4'-thiobis(2-chlorophenol), tetrakis(1,2,2,6,6-pentamethyl-4-piperidyl)-1,2,3,4-butane tetracarboxylate, and tetrakis(1,2,2,6,6-tetramethyl-4-piperidyl)-1,2,3,4-butane tetracarboxylate.

Besides the above-described leuco dyes, developers and stabilizers, it is possible to appropriately add, to the thermosensitive coloring layer, other materials customarily used in thermosensitive recording materials, such as a binder, a filler, a sensitizer, a crosslinking agent, a pigment, a surfactant, a fluorescent whitening agent and a lubricant.

The binder may be used if necessary in order to improve the adhesiveness and coatability of the layer. The binder is suitably selected depending on the intended purpose without any restriction. Specific examples of the binder resin include starches, hydroxyethyl cellulose, methyl cellulose, carboxy methyl cellulose, gelatin, casein, gum arabic, polyvinyl alcohols, salts of diisobutylene-maleic anhydride copolymers, salts of styrene-maleic anhydride copolymers, salts of ethylene-acrylic acid copolymers, salts of styrene-acryl copolymers and salt emulsions of styrene-butadiene copolymers.

The filler is suitably selected depending on the intended purpose without any restriction. Examples thereof include inorganic pigments such as calcium carbonate, aluminum oxide, zinc oxide, titanium dioxide, silica, aluminum hydroxide, barium sulfate, talc, kaolin, alumina and clay, and commonly known organic pigments. Among these, acidic pigments (those which exhibit acidity in aqueous solutions) such as silica, alumina and kaolin are preferable, with silica being particularly preferable from the viewpoint of developed color density. Calcined kaolin is preferable in the framework of the present invention.

To the thermosensitive colouring layer, various thermoplastic materials can be optionally added as a sensitivity improving agent (sensitizers). A sensitizer may improve the colouring effect in some instances by melting under the effect of heat and thereby providing a temporary solvent facilitating reaction between the leuco dye and developer. It is to be noted that, in the case heat resistance is required, such as in use for labeling of ready cooked food, it is preferred that the thermoplastic material not be added, or a compound having a melting point of 90° C. or higher be selected.

Examples of sensitizers include: fatty acids such as stearic acid, and behenic acid; fatty acid amides, such as stearic acid amide, and palmitic acid amide; metal salts of fatty acid, such as zinc stearate, aluminum stearate, calcium stearate, zinc palmitate, and zinc behenate; and others, such as p-benzylbiphenyl, terphenyl, triphenylmethane, benzyl p-benzyloxy benzoate, β-benzyloxynaphthalene, phenyl β-naphthoate, phenyl 1-hydroxy-2-naphthoate, methyl 1-hydroxy-2-naphthoate, diphenyl carbonate, glycol carbonate, dibenzyl terephthalate, dimethyl terephthalate, 1,4-dimethoxy naphthalene, 1,4-diethoxy naphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio)ethane, dibenzoyl methane, 1,4-diphenyl thiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxy biphenyl, p-propargyloxy biphenyl, dibenzoyloxy methane, dibenzoyloxy propane, dibenzyl disulfide, 1,1-diphenyl ethanol, 1,1-diphenyl propanol, p-benzyloxy benzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, dibenzyl oxalate, bis(4-methylbenzyl) oxalate, and bis(4-chlorobenzyl) oxalate. These may be used alone, or in combination.

The thermosensitive colouring layer can be formed by commonly known methods. To avoid reaction between components of the thermosensitive colouring layer, in preferred embodiments, dispersion is carried out separately and then liquids are mixed. Grinding with a binder and other components is performed typically so as to have a particle diameter of 0.2 μm to 3 μm, preferably 0.2 μm to 1 μm by using a disperser such as a ball mill, an Atriter or a sand mill. The resultant dispersion is mixed, if necessary, together with a filler and a hot-meltable material (sensitizer) dispersion liquid in accordance with a predetermined formulation, to thereby prepare a coating liquid of a thermosensitive colouring layer, followed by applying the thus-prepared coating liquid onto a support.

The thickness of the thermosensitive colouring layer varies depending on the composition of the thermosensitive colouring layer and intended use of the thermosensitive recording materials and cannot be specified flatly, but it is preferably 1 μm to 50 μm, more preferably 2 μm to 20 μm.

Protective Layer(s)

At least one protective layer is provided over the thermosensitive layer in the present invention. Several different protective layers can be overlaid on each other to focus respectively more on matching or barrier properties.

At least one protective layer in the thermosensitive recording medium of the present invention comprises particles of wax with an average particle size of at least 0.05 and at most 2.0 μm. Where there is more than one protective layer, it is solely the uppermost protective layer, the one furthest removed from the thermosensitive colouring layer and on the surface exposed to the outside, which needs to contain wax particles. The underlying protective layers may contain but do not need to contain wax particles.

Concerning the average particle size of the wax particles in the present invention, the value is as obtained in a method to measure average particle size, in the form of the median size ($D_{50}$), as measured by laser diffraction using a Laser Diffraction Particle Size Distribution Analyzer. This measurement can be carried out for example by the LA-950 machine produced by the company HORIBA LA-950.

Preferably, the melting point of the wax of the wax particles of the protective layer/uppermost protective layer is at least 80° C. and at most 200° C. More preferably, the wax melting point is at least 90° C. and at most 130° C., most preferably at least 100° C. and at most 120° C.

More preferably, the wax particle size is at least 0.1 μm and at most 0.5 μm.

In advantageous embodiments, the particles of wax constitute at least 2.0 wt. % and at most 20 wt. % with respect to 100 wt. % constituted by all the components of the protective layer taken as a whole, more preferably at least 5.0 wt. % and at most 10 wt. % with respect to 100 wt. % constituted by all the components of the protective layer taken as a whole.

The wax material of the wax particles in the present invention may be polyethylene wax, salts of higher fatty acids such as zinc stearate and calcium stearate, montanate wax, carnauba wax, paraffin wax, ester wax and metal salts thereof; higher fatty acid amides, higher fatty acid esters, animal wax, vegetable wax, mineral wax, and petroleum wax.

A particularly preferred wax material for the wax particles of a protective layer of the thermosensitive recording medium of the present invention is polyethylene wax. Low density or high density polyethylene wax particles may be used.

The protective layer(s) typically contain(s) at least a binder, and each of the protective layer(s) may contain an inorganic filler and a surfactant.

The binder of (each of) the protective layer(s) is suitably selected depending on the intended purpose without any restriction, it being possible to use the same binder in each protective layer or a different binder in separate protective layers. Examples of binders that may be used in the protective layer(s) include polyvinyl alcohol, modified polyvinyl alcohol, starch and derivatives thereof, cellulose derivatives, polyvinylpyrrolidone, polyethyleneimine, alginate soda, gelatin and casein. Acrylic binders may also be used. Hydrophobic resins that may be used as binders in the protective layer(s) include ones typically provided as aqueous emulsions during preparation of the protective layer(s), such as urethane resins, epoxy resins, vinyl acetate (co)polymers, vinylidene chloride (co)polymers, vinyl chloride (co)polymers, and styrene-butadiene copolymers. A particularly preferred binder material for the protective layer of the present invention is polyvinyl alcohol.

The thickness of the protective layer(s) varies preferably from 0.2 μm to 10 μm, more preferably from 0.5 μm to 5 μm. In non-limiting exemplary embodiments for this invention, a protective layer of thickness 2.5 μm when dry can be used. In the event that several protective layers are applied, lower individual thicknesses for each one will be required. A preferred maximum cumulative thickness for the sum of all protective layers is 10 μm for the dried final product.

The inorganic filler in the protective layer(s), if used, is suitably selected depending on the intended purpose without any restriction. Examples the inorganic filler include aluminum hydroxide, calcium carbonate, aluminum oxide, zinc oxide, titanium dioxide, silica, barium sulfate, talc, kaolin, alumina and clay. These may be used alone or in combination. Among these, aluminum hydroxide, and calcium carbonate are particularly preferable because the protective layer containing such inorganic filler is provided with excellent abrasion resistance with respect to a thermal head when printing is performed for a long period of time. The amount of the inorganic filler in the protective layer(s) is suitably selected depending on the intended purpose without any restriction. The amount of the inorganic filler depends on types of the filler, but it is preferably 50 parts by mass to 500 parts by mass, relative to 100 parts by mass of the binder resin.

In one advantageous embodiment of the present invention, a first protective layer is laid down on the thermosensitive colouring layer, and whilst it contains a binder such as polyvinyl alcohol (PVA), it does not contain wax particles. However, a second protective layer may be laid down on the first protective layer, the second protective layer thus not being in direct contact with the thermosensitive colouring layer, the second protective layer containing wax particles and possibly filler such as inorganic filler.

A method for forming the first, second or subsequent protective layer is suitably selected depending on the intended purpose without any restriction. Examples thereof include blade coating, roll coating, wire bar coating, die coating, and curtain coating. Such methods can be used to apply other layers of the thermosensitive recording medium of the present invention, such as the undercoat layer(s). Curtain coating is a preferred method for applying protective layer(s) in the present invention and can also be used to apply the thermosensitive colouring layer.

Back Layer

A back layer (which may also be called a "backing layer") may be provided under the transparent support layer in the thermosensitive colouring layer of the present invention. Such an intermediate layer is however not required in the present invention, but instead is only optional. In one embodiment, the thermosensitive recording medium may contain a back layer containing a pigment, a binder resin, and preferably a crosslinking agent. The back layer, if present, is to be disposed on the surface of the transparent support opposite to the surface thereof where the thermosensitive layer is disposed, or where the undercoat layer between the transparent support and the thermosensitive layer is situated, if such an undercoat layer is present.

The back layer may further contain other components such as a filler, a lubricant, and an antistatic agent.

As for the binder resin, either of a water-dispersible resin or a water-soluble resin can be used. Specific examples thereof include conventionally known water-soluble polymers, and aqueous polymer emulsions.

The water-soluble polymer is suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyvinyl pyrrolidone, alkali salts of styrene-maleic anhydride copolymers, alkali salts of isobutylene-maleic anhydride copolymers, alginate soda, gelatin and casein. These may be used alone or in combination.

The aqueous polymer emulsion is suitably selected depending on the intended purpose without any restriction. Examples thereof include latexes of, for example, styrene-butadiene copolymers; and emulsions of, for example, vinyl acetate resins, acryl-based resins (e.g. acrylic acid-acrylic acid ester copolymer latexes), (meth)acrylamide-based resins, and polyurethane resins. These may be used alone or in combination.

The crosslinking agent is suitably selected depending on the intended purpose without any restriction. Examples thereof include polyvalent amine compounds such as ethylene diamine; polyvalent aldehyde compounds such as glyoxal, glutalaldehyde and dialdehyde; dihydrazide compounds such as dihydrazide adipate and dihydrazide phthalate; polyamide-epichlorohydrin compounds; water-soluble methylol compounds (urea, melamine and phenol); multifunctional epoxy compounds; multivalent metal salts (e.g., Al, Ti, Zr and Mg); titanium lactate; and boric acid. The amount of the crosslinking agent varies depending on the amounts and types of functional groups of the crosslinking agent, but it is preferably 0.1 parts by mass to 100 parts by mass, more preferably 1 part by mass to 100 parts by mass, relative to 100 parts by mass of the binder resin.

As the filler, either an inorganic filler or an organic filler may be used. Examples of the inorganic filler include carbonates, silicates, metal oxides and sulfate compounds. Examples of the organic filler include silicone resins, cellulose resins, epoxy resins, nylon resins, phenol resins, polyurethane resins, urea resins, melamine resins, polyester resins, polycarbonate resins, styrene resins, polyethylene resins, and formaldehyde resins.

The antistatic agent may, for example, be selected from commonly used ion-conducting antistatic agents and electron-conducting antistatic agents. Specific examples of the ion-conducting antistatic agents include inorganic salts such as sodium chloride; anionic polymers such as sodium polystyrenesulfonate; and resins containing quaternary ammonium salts that are electrolyte cations. Specific examples of the electron-conducting antistatic agents include conductive metal compounds such as conductive tin and antimony oxide; and conductive polymers such as polyaniline. Among these antistatic agents, polystyrene sulfonic acid salts, in particular, react with aziridine, thereby improving water resistance obtained by means of cross-linkage. Additionally, salts which have copolymerized with maleic acid are effective in that they have antistatic properties and also improve water resistance.

A method for forming the back layer is suitably selected depending on the intended purpose without any restriction. The back layer is preferably formed by applying a coating liquid of the back layer to a support.

The coating method is suitably selected depending on the intended purpose without any restriction. Examples thereof include blade coating, roll coating, wire bar coating, die coating, and curtain coating.

The thickness of the back layer is suitably selected depending on the intended purpose without any restriction. It is preferably 0.1 μm to 10 μm, more preferably 0.5 μm to 5 μm.

Viscous Layer

A viscous layer, also called an adhesive layer, may be provided in the thermosensitive recording medium of the present invention. Such a viscous layer is however not required in the present invention, but instead is only optional.

A viscous layer may be provided on a surface of the support layer, or backing layer, opposite to the surface over which the protective layer is formed. The viscous layer may, for example, help to attach the thermosensitive recording medium to a food package in a typical application of the present invention. The thermosensitive recording medium of the invention can thus be provided with an adhesive surface attached to the support or backing layer, which is useful in order to provide a label which has an adhesive layer. A releasable liner may then be attached to the adhesive layer, to be removed before final attachment to a product to be labelled. The viscous layer may also provide antistatic properties. The method for forming the viscous layer is not particularly limited. Examples of the method include common coating methods and laminating methods. The average thickness of the viscous layer is not particularly limited, may be appropriately selected depending on the intended purpose, and is preferably 0.1 μm or greater but 20 μm or less.

The material of the viscous layer is not particularly limited and may be appropriately selected depending on the intended purpose. Examples of the material of the viscous layer include urea resins, melamine resins, phenol resins, epoxy resins, vinyl acetate-based resins, vinyl acetate-acrylic-based copolymers, ethylene-vinyl acetate copolymers, acrylic-based resins, polyvinyl ether-based resins, vinyl chloride-vinyl acetate-based copolymers, polystyrene-based resins, polyester-based resins, polyurethane-based resins, polyamide-based resins, chlorinated polyolefin-based resins, polyvinyl butyral-based resins, acrylic acid ester-based copolymers, methacrylic acid ester-based copolymers, natural rubbers, cyano acrylate-based resins, and silicone-based resins. One of these materials may be used alone or two or more of these materials may be used in combination. These materials may be cross-linked by means of a cross-linking agent. The material of the viscous layer may be a hot-melt type. In one aspect of the invention, a label including the thermosensitive recording medium of the invention is in the form of a silicone linerless (SLL) label.

Image Recording Method

An image recording method may be used for recording an image on the thermosensitive recording medium of any of the embodiments of the present invention using an image recording unit, which is any one of a thermal head and a laser.

The thermal head is suitably selected depending on the intended purpose without any restriction regarding the shape, structure and size thereof.

The laser may be selected depending on the intended purpose without any restriction. In one preferred embodiment, a $CO_2$ laser which emits light having a wavelength of 9.3 μm to 10.6 μm may be used. By using the $CO_2$ laser which emits light having a wavelength of 9.3 μm to 10.6 μm, a satisfactory laser print image can be obtained without using a photothermal conversion agent such as a phthalocyanine pigment. Other laser types may be used, such as FLDA (Fiber Laser Diode Array).

EXAMPLES

Hereinafter, the present invention will be specifically described based on Examples and Comparative Examples. However, it should be noted that the present invention is not confined to these Examples in any way. It should be noted that in the following examples, the unit "part(s) means "part(s) by mass" and the unit "%" means "% by mass" unless otherwise specified.

Example 1

A thermosensitive recording medium was created in accordance with the following steps.

1) A coating liquid for an undercoat layer was applied over a substrate, and thereby the undercoat layer (having 3 g/m2 as dry mass) was created. In this example, a wood free paper, having a basic weight of about 60 g/m2, was used. The prescription of the coating liquid for the undercoat layer is below.

Prescription of the Coating Liquid for the Undercoat Layer

Preparation of coating liquid for under layer:

Liquid A

Fine spherical hollow plastic particles [1)] 44 parts

Latex of styrene/butadiene copolymer [2)] 25 parts

10% aqueous polyvinyl alcohol solution[3)] 13 parts

Water 18 parts 1) copolymer resin based on styrene/acryl, solid content: 26.5%, average particle diameter: 1 μm, hollow rate: 55%

2) solid content: 47.5%

3) Fully hydrolysed PVA

The coating liquid of the undercoat layer was uniformly applied to the base paper surface and then dried, to thereby form an undercoat layer.

2) A coating liquid for a thermal recording layer was applied over the undercoat layer, and thereby the thermal recording layer was created.

With regard to the preparation of a coating liquid of a thermosensitive colouring layer, the following compositions were prepared:

[Liquid B] Dye dispersion liquid 2-anilino-3-methyl-6-(di-n-butylamino)fluoran (Dye) 32 parts 10% itaconic-modified polyvinyl alcohol aqueous solution 32 parts Water 36 parts

[Liquid C] Developer dispersion liquid

Developer [1)] 16 parts

Silica [2)] 16 parts

10% aqueous polyvinyl alcohol solution[3)] 32 parts

Water 36 parts

1) N-[2-(3-phenylureido)phenyl]benzenesulfonamide: formula (II) as defined in the present description and claims 2) MIZUKASIL P-527 manufactured by MIZUSAWA INDUSTRIAL CHEMICALS, LTD 3) Itaconic-modified polyvinyl alcohol by KURARAY in aqueous solution

[Liquid D] Co-developer dispersion liquid

Co-developer[1)] 32 parts

10% aqueous polyvinyl alcohol solution[2)] 32 parts

Water 36 parts

1) See Table 1: wherein co-developer could be: UU, D-90 or P-201

2) Itaconic-modified polyvinyl alcohol by KURARAY in aqueous solution

[Liquid E] Sensitizer dispersion liquid

Sensitizer[1)] 32 parts

10% aqueous polyvinyl alcohol solution[2)] 32 parts

Water 36 parts

1) See Table 1: wherein sensitizer could be: HS3520 or EGMTE

2) Itaconic-modified polyvinyl alcohol by KURARAY in aqueous solution

[Liquid B], [Liquid C], [Liquid D] and [Liquid E] having the aforementioned compositions respectively, were each dispersed using sand mill, so that particles contained in each liquid had an average particle size diameter of 1 μm or less, to thereby prepare a dye dispersion liquid [Liquid B] and a developer dispersion liquid [Liquid C] and a co-developer dispersion liquid [Liquid D] and a sensitizer dispersion liquid [Liquid E]. Then [Liquid B], [Liquid C], [Liquid D] and [Liquid E] were mixed in the ratio below:

[Liquid B]=1.0

[Liquid C]=3.0

[Liquid D]=from 0 to 2.0 (see Table 1)

[Liquid E]=from 0 to 1.0 (see Table 1)

This mixture dry solid content is adjusted at 25% by water adding, followed by stirring, to thereby prepare a coating liquid of a thermosensitive colouring layer [Liquid F].

[Liquid F] was uniformly applied to undercoat layer to thereby form a thermosensitive colouring layer.

The coating amount of the thermal layer was such as to produce a dye coating weight of 0.6 g/m2 on a dry basis, then dried, to thereby form a thermosensitive colouring layer.

3) Coating liquids (a first coating liquid and a second coating liquid) for a double-layered protective layer was applied over the undercoat layer so that an upper protective layer formed of the first coating liquid is present over a lower protective layer formed of the second coating liquid, and thereby the double-layered protective layer was created over the thermal recording layer. The upper and lower protective layers had thickness of 1 g/m2 and 1 g/m2 respectively on a dry basis. The prescription of the coating liquids for the double-layered protective layer are below; they were then dried.

[Liquid G] First protective layer liquid

10% aqueous polyvinyl alcohol solution[1)] 70 parts

20% polyamide epichlorohydrin[2)] 15 parts

Water 15 parts

1) Itaconic-modified polyvinyl alcohol by KURARAY in aqueous solution

2) KYMENE-920 from SOLENIS

[Liquid I] Second protective layer liquid

Liquid H[1)] 18 parts

Wax[2)] 2 parts

20% polyamide epichlorohydrin[3)] 4 parts

10% aqueous polyvinyl alcohol solution[4)] 20 parts

Water 56 parts

1) Liquid H: see bellow prescription of the liquid dispersion

2) Wax mentioned in Table 1:

J-206: from Chukyo

Ultralube E-842N: from Keim Additec GmbH

Aquacer-1031: from BYK

Chemipearl W-400: from Mitsui Chemicals

Hidorin EZ-740: from Chukyo

3) KYMENE-920 from SOLENIS

4) Itaconic-modified polyvinyl alcohol by KURARAY in aqueous solution

[Liquid H] Filler dispersion liquid

Apy-100[1)] 32 parts

10% aqueous polyvinyl alcohol solution[1)] 32 parts

Water 36 parts

1) Apy-100 from Nabaltec GmbH

2) Itaconic-modified polyvinyl alcohol by KURARAY in aqueous solution

After coating, samples were aged at 50° C. during 48 h. Further to this process, samples were calendered at 20 kgF, before proceeding with quality evaluation.

Examples 2 to 12; Comparative Examples 1 to 3

In Examples 2 to 12 and Comparative Examples 1 to 3, in each case, a thermosensitive recording medium was prepared according to Example 1, except where changes are indicated in following Table 1. Thus, different types of waxes were compared in Examples 1 to 3. A high level of wax is tested in Example 4. Examples 5 to 9 test the effects of codevelopers and the amount thereof. Examples 10 to 12 test the effects of sensitizers in the thermosensitive colouring layer. In Comparative Examples 1 to 3, the particle sizes (PS) of the wax particle used in the protective layer are outside the scope of the present invention.

In Table 1 below:

STD refers to the standard undercoat layer as detailed as [Liquid A] in section 1) of Example 1 above Developer refers to the formula (II) as defined in the present description and claims HS3520 refers to Bis(4-methyl benzyl) oxalate EGMTE refers to 1,2-bis(3-methylphenoxy)ethane Ste-Zn refers to zinc stearate PE refers to polyethylene PS refers to particle size WB refers to a wirebar coating method Methods of Evaluation In order to test migration of coloured components, a barcode image, typical in use of a thermosensitive recording medium according to the present invention, was produced on a sample thermosensitive recording medium by irradiation, and the printed medium was kept in contact with two sheets of polyvinyl chloride (PVC produced by Shin-Etsu Polymer Co., Ltd) at 50° C. for 3 days. The degree of optical black density showing migration of coloured components in the printed image to the PVC was measured with a spectrophotometer (instrument name=Exact, available from X-Rite, Inc.). At a density of 0.10, visual inspection suggests that there is no migration of coloured components. At a density of 0.15, whilst the beginning of a transferred image is visible, the result is considered acceptable in practical use. The maximum acceptable density in practical use is considered to be 0.20. At a density of 0.35, the barcode provided is clearly visible transferred to the PVC (even if not as sharp as the original), and this level of image transfer is considered unacceptable. In descending order of acceptability, the following ranking is provided: rank I: density ≤0.11; rank II: density 0.12-0.14; rank III: density 0.15-0.19; rank IV: density ≥0.20.

The alcohol resistance of the background was tested by wiping a thermosensitive recording medium in cotton impregnated with 100% ethanol (EtOH). The resulting density of ≤0.09 was considered a good result, with rank I. For a density of 0.10 or greater, considered to be acceptable, rank II is awarded.

Plasticizer resistance of the image was assessed as follows: In order to test plasticizer resistance of coloured components, a barcode image, typical in the use of a thermosensitive recording medium according to the present invention, was produced on a sample thermosensitive recording medium by irradiation, and the printed medium was kept in contact with a sheet of polyvinyl chloride (PVC) at 50° C. for 3 days. The degree of optical black density showing remaining coloured components in the printed image was measured. Preservation rate means:

Preservation rate (%)=[degree of optical black density after test]/[degree of optical black density before test]*100

Rank I: preservation rate >85% (Good level)

Rank II: preservation rate <84% (Poor level)

Dynamic sensitivity was assessed as follows: A MarkPoint MK2 printer was used to print images using an applied energy of 8.88 mJ per $mm^2$. The black optical density was measured with a spectrophotometer (Instrument name=Exact, available from X-Rite, Inc.). The value is preferably 1.20 or greater.

Rank I: The optical density was more than 1.20

Rank II: The optical density was lower than 1.19

TABLE 1

| | | Examples 1 | 2 | 3 | 4 | 5 | 6 | 7 | 8 |
|---|---|---|---|---|---|---|---|---|---|
| Undercoat layer | STD | STD | STD | STD | STD | STD | STD | STD | STD |
| Thermal layer | Dev Formula | (II) | (II) | (II) | (II) | (II) | (II) | (II) | (II) |
| | Co-Dev | No | No | No | No | UU | D-90 | P-201 | UU |
| | Ratio of Co-Dev | 0.00 | 0.00 | 0.00 | 0.00 | 0.20 | 0.20 | 0.20 | 0.02 |
| | Sensitizer | No | No | No | No | No | No | No | No |
| Protect layer | Wax | J-206 | E842 | AQ-1031 | E842 | E842 | E842 | E842 | E842 |
| | Type of Wax | Montan | PE | PE | PE | PE | PE | PE | PE |
| | m. p. of Wax | 80° C. | 110° C. | 100° C. | 110° C. | 110° C. | 110° C. | 110° C. | 110° C. |
| | PS of Wax | 1.00 | 0.23 | 0.09 | 0.23 | 0.23 | 0.23 | 0.23 | 0.23 |
| | Constitute wt % | 2.0 | 2.0 | 2.0 | 20.0 | 2.0 | 2.0 | 2.0 | 2.0 |
| Coating method | | WB | WB | WB | WB | WB | WB | WB | WB |
| Migration of coloured components | Density | 0.14 | 0.13 | 0.12 | 0.14 | 0.11 | 0.11 | 0.12 | 0.11 |
| PVC/50° C. 3 days | Rank | II | II | II | II | I | I | II | I |
| Alcohol resistance | Density | 0.07 | 0.07 | 0.07 | 0.08 | 0.08 | 0.07 | 0.09 | 0.07 |
| Background 100% EtOH Wipe | Rank | I | I | I | I | I | I | I | I |

TABLE 1-continued

| | | | | | | | | | |
|---|---|---|---|---|---|---|---|---|---|
| Plasticizer resistance of image | Rank | II | II | II | II | I | I | I | II |
| Dynamic sensitivity | Rank | II | II | II | II | II | II | II | II |

| | | | 9 | 10 | 11 | 12 | Comp. Ex. 1 | 2 | 3 |
|---|---|---|---|---|---|---|---|---|---|
| Undercoat layer | STD | | STD | STD | STD | STD | STD | STD | STD |
| Thermal layer | Dev Formula | | (II) | (II) | (II) | (II) | (II) | (II) | (II) |
| | Co-Dev | | UU | UU | UU | UU | No | No | UU |
| | Ratio of Co-Dev | | 2.00 | 0.20 | 0.20 | 0.20 | 0.00 | 0.00 | 0.20 |
| | Sensitizer | | No | EGMTE | HS3520 | HS3520 | No | No | No |
| Protect layer | Wax | | E842 | E842 | E842 | E842 | W400 | HZ836 | HZ836 |
| | Type of Wax | | PE | PE | PE | PE | PE | Ste-Zn | Ste-Zn |
| | m. p. of Wax | | 110° C. | 110° C. | 110° C. | 110° C. | 110° C. | 120° C. | 120° C. |
| | PS of Wax | | 0.23 | 0.23 | 0.23 | 0.23 | 4.0 | 5.5 | 5.5 |
| | Constitute wt % | | 2.0 | 2.0 | 2.0 | 2.0 | 2.0 | 2.0 | 2.0 |
| Coating method | | | WB | WB | WB | Curtain | WB | WB | WB |
| Migration of coloured components | | Density | 0.11 | 0.10 | 0.10 | 0.10 | 0.20 | 0.23 | 0.21 |
| PVC/50° C. 3 days | | Rank | I | I | I | I | IV | IV | IV |
| Alcohol resistance | | Density | 0.12 | 0.09 | 0.09 | 0.08 | 0. 07 | 0.07 | 0.10 |
| Background 100% EtOH Wipe | | Rank | II | I | I | I | I | I | II |
| Plasticizer resistance of image | | Rank | I | I | I | I | II | II | I |
| Dynamic sensitivity | | Rank | II | I | I | I | II | II | II |

REFERENCE SIGNS LIST

1: Thermosensitive recording medium
11, 11*a*, 11*b*: Protective layer(s)
12: Thermosensitive colouring layer
13: Support layer
14: Undercoat layer
15: Back layer

The invention claimed is:

1. A thermosensitive recording medium comprising at least:

a support layer;

a thermosensitive colouring layer over the support layer, the thermosensitive colouring layer containing a leuco dye; and a protective layer over the thermosensitive colouring layer, wherein the thermosensitive colouring layer comprises a developer having the general formula (I) below:

(I)

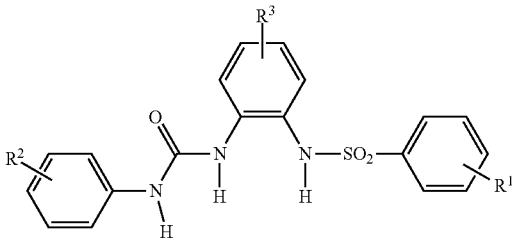

in which R1 to R3 each independently represent a hydrogen atom, a halogen atom, a C1-C6 alkyl group, a C1-C6 alkoxyl group, a C1-C6 fluoroalkyl group, and the protective layer comprises particles of polyethylene wax or montan wax, the particles of polyethylene wax or montan wax having an average particle size of at least 0.05 μm and at most 1.0 μm, and constituting at least 2.0 wt.% and at most 20 wt. % with respect to 100 wt. % constituted by all the components of the protective layer taken as a whole.

2. The thermosensitive recording medium according to claim 1, wherein the particles of wax are particles of polyethylene wax.

3. The thermosensitive recording medium according to claim 1, wherein the melting point of the wax is at least 80° C. and at most 200° C.

4. The thermosensitive recording medium according to claim 3, wherein the melting point of the wax is at least 90° C. and at most 130° C.

5. The thermosensitive recording medium according to claim 1, wherein the particle size of the wax particles in the protective layer is at least 0.1 μm and at most 0.5 μm.

6. The thermosensitive recording medium according to claim 1, wherein the particles of wax constitute at least at least 5.0 wt. % and at most 10 wt. % with respect to 100 wt. % constituted by all the components of the protective layer taken as a whole.

7. The thermosensitive recording medium according to claim 1, wherein the developer has the following formula (II):

(II)

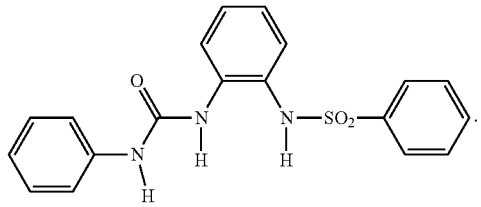

8. The thermosensitive recording medium according to claim 1, wherein the thermosensitive colouring layer further includes a co-developer chosen from the group consisting of:

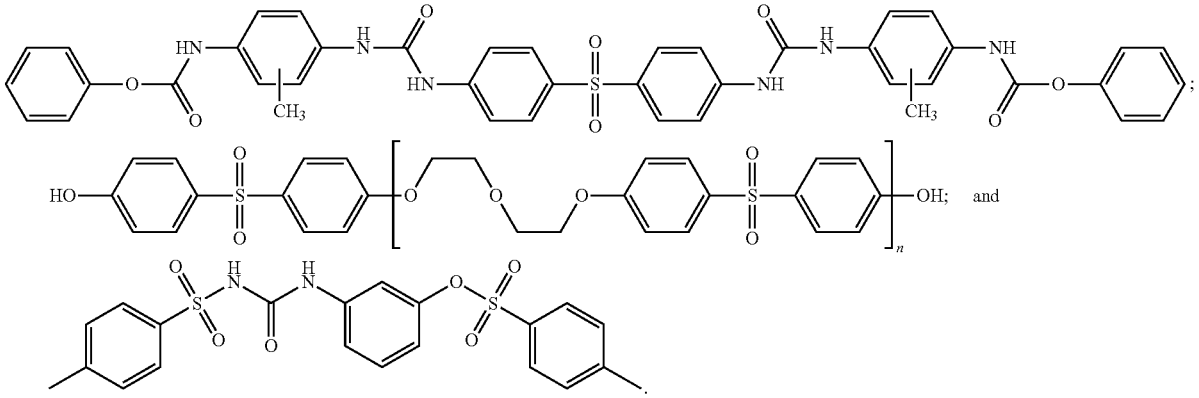

9. The thermosensitive recording medium according to claim 8, wherein the co-developer is a urea urethane (UU) compound of formula:

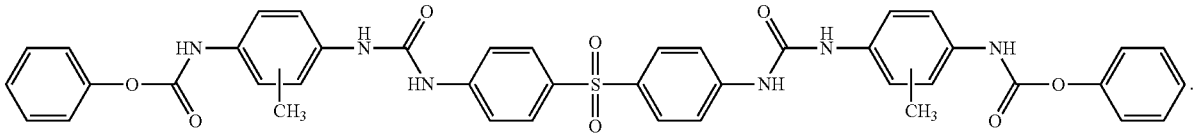

10. The thermosensitive recording medium according to claim 9, wherein the weight ratio of urea urethane (UU) in the thermosensitive colouring layer, with respect to the amount of developer having the general formula (I), is at least 0.02 and at most 2.0.

11. The thermosensitive recording medium according to claim 10, wherein the weight ratio of urea urethane (UU) in the thermosensitive colouring layer, with respect to the amount of developer having the general formula (I), is at least 0.05 and at most 0.20.

12. The thermosensitive recording medium according to claim 10, wherein the weight ratio of urea urethane (UU) in the thermosensitive colouring layer, with respect to the amount of developer having the general for (I), is at least 0.05 and at most 0.10.

13. The thermosensitive recording medium according to claim 1, wherein a back layer is under the support layer, on the opposite side of the support layer with respect to the thermosensitive colouring layer.

14. The thermosensitive recording medium according to claim 1, wherein an undercoat layer is present between the support layer and the thermosensitive colouring layer.

15. The thermosensitive recording medium according to claim 14, wherein the undercoat layer includes hollow particles.

16. The thermosensitive recording medium according to claim 1, wherein the protective layer is an uppermost protective layer and one or more lower protective layers are present between the thermosensitive colouring layer and the uppermost protective layer.

17. A label for attachment to a product comprising the thermosensitive recording medium according to claim 1, wherein the label is either provided with a releasable liner, or is in the form of a silicone linerless label.

18. A consumer product package to which a thermosensitive recording medium according to claim 1 has been attached.

19. The consumer product package according to claim 18, wherein a consumer product is covered with a plastic film including a plasticizer.

20. The consumer product package according to claim 19, wherein the plastic film is a poly(vinyl chloride) film.

21. A consumer product package to which the label according to claim 17 has been attached.

* * * * *